United States Patent [19]

Witt

[11] Patent Number: 4,620,584

[45] Date of Patent: Nov. 4, 1986

[54] GREEN SAND MOLD FILLING SYSTEM

[76] Inventor: Raymond H. Witt, 28240 Grand River, Farmington, Mich. 48024

[21] Appl. No.: 737,459

[22] Filed: May 24, 1985

[51] Int. Cl.[4] ..... B22C 15/28

[52] U.S. Cl. ..... 164/160.1; 164/195

[58] Field of Search ..... 164/7.1, 160.1, 38, 164/195

[56] References Cited

U.S. PATENT DOCUMENTS

| | | | |
|---|---|---|---|
| 1,475,935 | 12/1923 | Coleman | 164/37 |
| 3,293,703 | 12/1966 | Taccone | 164/160.1 |
| 3,858,639 | 1/1975 | Larkin | 164/38 X |
| 4,103,733 | 8/1978 | Edwards | 164/160.1 |

*Primary Examiner*—Nicholas P. Godici
*Assistant Examiner*—J. Reed Batten, Jr.
*Attorney, Agent, or Firm*—Cullen, Sloman, Cantor, Grauer, Scott and Rutherford

[57] ABSTRACT

A green sand mold filling system is formed of an air chamber box having a cover plate which supports a pattern. Air passageway holes, which communicate with the air chamber, extend through the plate and pattern at preselected locations, such as difficult to fill pockets, depressions and the like. An open top and bottom flask section is positioned over the plate and around the pattern. Filling sand is poured into the flask and is mechanically compacted or squeezed therein. During the filling and squeezing, a vacuum is provided in the air chamber and, therefore, through the air passageway holes, to assist the sand flow into and the sand densification at the pre-selected locations. Thereafter, the vacuum is discontinued and pressurized air is provided in the air chamber and, therefore, through the air passageway holes, to assist in separation of the compacted sand from the pattern and plate and to maintain the integrity and accuracy of the cavity formed in the sand while the flask section is removed.

1 Claim, 3 Drawing Figures

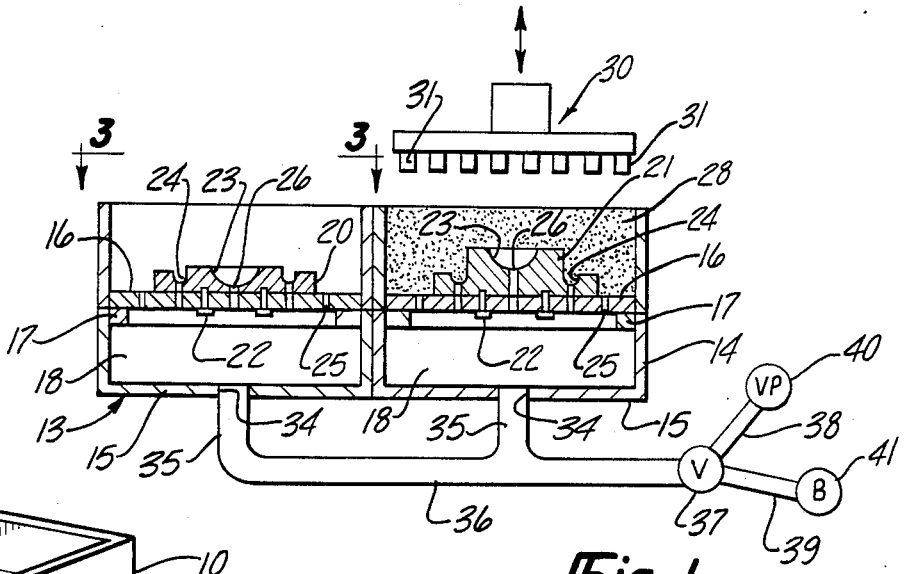
Fig-1
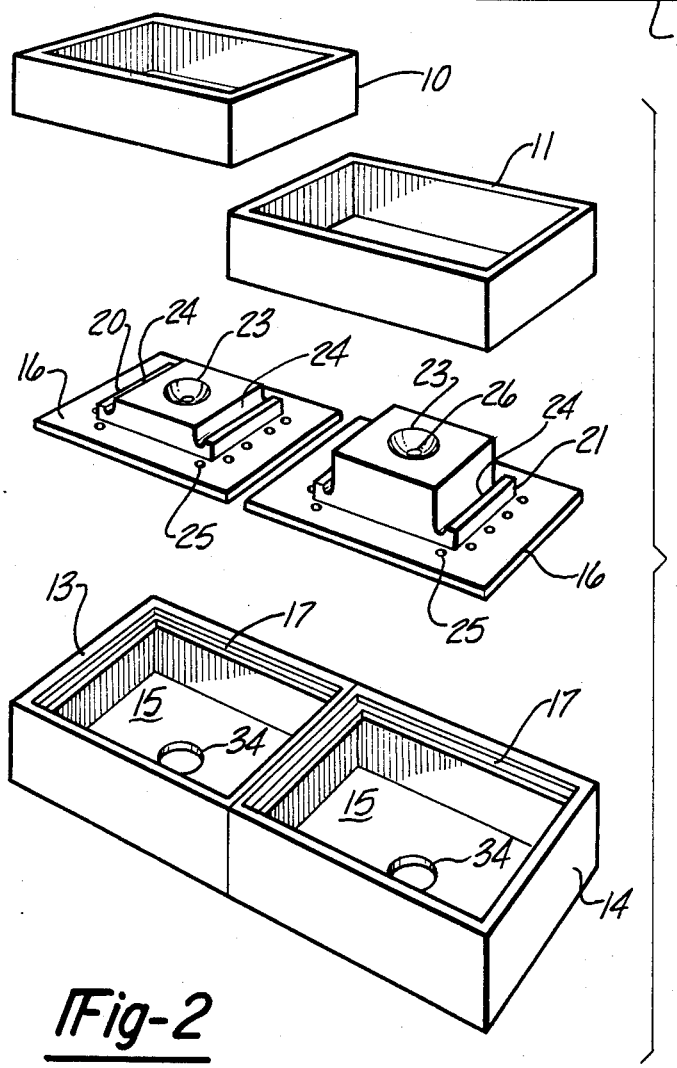
Fig-2
Fig-3
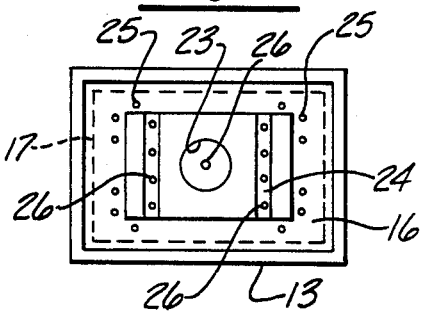

GREEN SAND MOLD FILLING SYSTEM

BACKGROUND OF INVENTION

Metal casting, green sand filled molds are typically formed of open top and bottom, box-like cope and drag, flask sections which are placed one upon the other during casting. While the sections are separated, a wood or metal pattern part is placed within each of the flask sections to form part of the mold cavity in each section. The two pattern parts, when aligned together, make up the complete mold cavity. "Green sand" is poured into each of the two separated flask sections and is compacted or squeezed into the flask section and particularly, around the pattern part continued within the section. Thereafter, each of the completed sand filled flask sections is moved away from, e.g., lifted off, its pattern part, leaving a cavity therein.

The two mold sections are then placed, one upon another, in registration, so that their cavities are aligned to provide the complete mold cavity for receiving molten metal for casting.

In this common type of mold forming procedure, it is difficult to completely fill and compact the filling sand within certain portions of the mold, such as those places that form pockets or depressions or interior corners, or the like. In many instances, the sand filling will not completely fill and properly compact within odd shaped or relatively small depressions in the cavity walls.

Significantly, where a pattern has depressions or pockets or odd shaped areas, when the pattern and the flask section are separated after filling and compacting the sand, there is a tendency for the sand at the cavity wall surface to stick to the pattern surface. This causes some slippage of sand at, or loss of portions of the sand forming, the surface of the cavity in the mold. This slight slippage or loss of sand affects the accuracy of the cavity, the sharpness of corners and pockets and the like within the cavity and the integrity of the wall of the cavity, particularly at thin or irregular sections thereof.

In some instances, to avoid what otherwise might be a filling and compacting problem, pre-formed cores are used. These typically are made of sand or the like which are baked or bonded to form a relatively rigid structure that is inserted within the cavity to form part of the cavity wall. Although said cores are commonly needed for many casting purposes, there are times when such cores are used because of the difficulty in filling and properly compacting or densifying the sand in particular places in the mold cavity due to depressions or pockets or similar irregular shapes in the patterns.

Consequently, the invention herein relates to an improved system for filling and densifying the green sand in preselected places in the mold section and, further, in better releasing the same from the pattern when the sand filled mold section and the pattern are separated.

SUMMARY OF INVENTION

The invention herein relates to a system for better filling and for densifying the sand poured into the sections of a green sand casting flask by applying a vacuum around and through the pattern at preselected, difficult to fill locations, and later applying pressurized air through the same holes while the sand filled flask section and the pattern are separated for maintaining the integrity of the surfaces of the mold cavity. This is accomplished by mounting a pattern half or section upon a support plate with air passageway holes extending through the plate and through the pattern at preselected locations which are otherwise difficult to fill and compact. The air passageway holes communicate with an air chamber beneath the plate. The flask section, i.e., the cope or drag sections, are positioned over the plate and around the pattern half.

A vacuum is applied in the air chamber so as to provide a vacuum through the air passageway holes through the plate and pattern during the time that sand is poured into the flask section around the pattern and also during the time that the sand is compacted or squeezed within the mold. This assists in filling and in densifying the sand at the preselected places. Thereafter, the vacuum is discontinued and pressurized air is flowed into the air chamber and through the holes in the plate and pattern. The pressurized air further densifies and assists in maintaining the integrity of the sand at the cavity surface as the flask is lifted away from the pattern.

The invention contemplates simultaneously filling the cope and drag sections in the same manner and upon the same apparatus so that in a single step, the cavities in both the cope and drag sections of a single flask are formed.

An object of this invention is to provide a denser sand filling at predetermined cavity locations, particularly at the surface of the cavity, to produce better dimensional accuracy on castings formed therein. In addition, the denser, more accurate cavity surfaces help reduce parting line run-outs when pouring metal into the mold.

Another object of this invention is to reduce or eliminate the sticking of the sand to the pattern during the time the mold is stripped from the pattern. This results in producing more accurate castings and reduces the instances where excessive metal is used in a casting due to erosion of the cavity wall surface because of sand sticking to the pattern during stripping.

Still a further object is to utilize a vacuum to assist in filling and compacting the sand within a mold flask, particularly within hard to fill depressions, pockets and the like in the pattern, and thereafter utilizing pressurized air to assist in stripping the filled flask section from the pattern with minimal damage to the cavity surface and with a more dense filling, particularly at the cavity surfaces.

These and other objects and advantages of this invention will become apparent upon reading the following description, of which the attached drawings form a part.

DESCRIPTION OF DRAWINGS

FIG. 1 is a schematic, cross-sectional drawing of the cope and drag flask sections, arranged side-by-side over their respective pattern halves which are supported upon plates forming the covers of air chambers.

FIG. 2 is a schematic, perspective view, of separated cope and drag sections, pattern halves, support plates, and air chambers.

FIG. 3 is a plan view, taken in the direction of arrows 3—3 in FIG. 1 and showing air passageway holes in the pattern half and supporting plate.

DETAILED DESCRIPTION

The drawings schematically illustrate a cope section 10 and a drag section 11 of a conventional sand casting flask. These flask sections are rested upon box-like support stools 13 and 14 which are arranged side-by-side to form a support unit.

The stools each have a floor 15 and are covered by a support plate 16 which may be held upon a continuous ledge 17 arranged around the interior wall surfaces of the stools. Thus, the stools form air chambers 18.

In conventional sand casting, a wood or metal pattern is used to form the mold cavity. Typically, the pattern is formed in two "halves" or section 20 and 21. Together, when appropriately registered or aligned, the two pattern halves make up the complete casting. Thus, each pattern half forms part of the overall cavity in its particular cope or drag section of the flask.

As shown schematically in FIG. 1, the two pattern halves or sections 20 and 21 are different in size for illustrative purposes. Each is placed upon the support plate 16 within the respective cope or drag sections and may be secured in place by mechanical fasteners, such as screws 22. Thus, each pattern half remains with the support plate which, in turn, remains with the stool over the air chamber therein.

The patterns obviously will vary in shape and size depending upon the particular casting desired. For illustrative purposes, the patterns are shown as having closed pockets or depressions 23 at their centers and open pockets or depressions or channels 24 along their opposite sides. These are ordinarily difficult to fill with loose sand and it it difficult to compact or densify the sand in such pattern places or areas.

A number of air pasageways 25 extend through the support plates 16 to communicate with the air chambers 18 beneath them. In addition, air passageways 26 are formed through the patterns into the pockets or depressions or channels 23 and 24. The air passageways through the patterns register or communicate with at least some of the air passageways through the plate so as to permit passage of air from or to the air chambers.

The location of the air passageways and the number of them must be determined by experience depending upon the particular shape or size or configuration of the preselected location which is likely to be a problem area for filling and densifying the sand. As can be seen in the drawings, as for example in FIG. 3, some of the passageways 25 in the plate may be along the outside edges or corners of the particular pattern half in order to insure good sand filling and densification at sharp corners or fillets or the like places which otherwise could cause a filling problem.

After the cope and drag sections are positioned upon the stools around the respective pattern halves, sand is poured into each. The sand filling equipment is conventional and ordinarily filling machinery is used. Obviously, hand filling by shovel could also be used where desired. As is conventional, the sand filling 28 (see FIG. 1) is compacted or squeezed down against the pattern and support plate. Conventional hydraulic compactor equipment 30 is used for this purpose. Typically, such compactors have hydraulically movable compacting feet 31 which reciprocate into and out of the flask section to squeeze or compact the sand filling. Since such equipment is conventional, no further description thereof is given here.

Each of the stools has an opening 34 in its floor 15 which is connected by a pipe 35 to a header or duct 36. This connects through a control valve 37. The valve, in turn, is connected by ducts or pipes 38 and 39 to a vacuum pump 40 and a compressed air blower 41 or a compressed air source of other conventional types.

The valve 37 may be manually operated, or for high production purposes, may be controlled by a timer or other mechanical or electrical mechanism of the types which are conventionally available on the market for operating valves cyclically at predetermined times.

In operation, the first step involves placing the cope 19 and drag 11 sections upon the stools 13 and 14 as illustrated schematically in FIG. 1. Thereafter, the sand filling 28 is dumped into the flask sections. The sand filling is compacted during the time sand is dumped into the flask section in the conventional manner, that is, either by alternating dumping and compacting steps or by completely filing and over-filling and then compacting.

During the time that the sand is poured or dumped into the flask section and the compacting step is taking place, the valve 37 is operated so as to connect the vacuum pump 40 to the air chambers 18 in the stools. During the time, air is sucked through the passageways 25 and 26 in the support plates and pattern halves. The amount of vacuum required, may be varied based upon testing and experience for the particular mold forming operation. The vacuum through the relatively small air passages, which are sized small enough so as to preclude flow of sand therein, assists in drawing sand into the otherwise difficult to fill depressions, pockets, pattern surface irregularities, sharp corners, and the like. The vacuum, in addition to assisting in fully filling the preselected locations, causes the sand therein to densify or compact. The degree of densification or compacting will vary depending upon the size and shape of the location and the amount of vacuum, but can be controlled by the amount of vacuum and the number of holes and the amount of time of application of vacuum, etc.

Once the flask sections are filled and compacted, the valve 37 is operated so as to disconnect the vacuum pump. Now, the flask sections are lifted up, away from the pattern halves in order to provide the casting cavities within the flask sections. As the flask sections are separated from the pattern, the valve 37 is operated to connect the compressed air source or blower 41 to the air chambers so as to provide pressurized air through the air passageways 25 and 26. This pressurized air flow into the gap forming between the sand surface of the cavity and the adjacent surface of the pattern, which gap appears as the mold section and pattern are separated, applies a pressure against the cavity surface, particularly at the problem areas where the holes are located. The pressurized air, therefore, further densifies or compacts the sand surface of the cavity and, in addition, protects the sand against sticking to the pattern surface and protects against slippage of the sand during the movement of the mold section. Thus, the mold cavity surfaces and structural integrity, particularly where there are irregular shapes, are maintained during the separation step.

After the flask sections are removed, they are then assembled together, one upon the other, to register their cavities and form the complete casting cavity ready for pouring of the molten metal therein. For that purpose, suitable sprues, vent holes, and the like must be formed in them. However, since these are conventional practices, details are omitted.

With a suitably automated system wherein the cope and drag sections are moved upon and removed from the stools with suitable conveying equipment, molds can be rapidly formed with a high degree of cavity accuracy and surface integrity. Thus, a complete pair of flask sections may be filled and removed in a cycle which is considerably less than one minute long.

Having fully described an operative embodiment of this invention, I now claim:

1. A mold densification system for sand casting cavity molds, comprising:

first and second interconnected open top substantially box-like support stools arranged side by side, each support stool having a continuous interior support ledge below said top and a floor positioned a spaced distance below said ledge; first and second generally flat pattern support plates each having an upper face upon which a pattern is secured and a lower face resting on its outer perimeter upon the ledge of said respective stools adjacent said top to form an air chamber between the plate and floor;

air passageway holes extending through the plate at preselected locations;

and air passageway holes registering with at least some of the plate holes and formed through the patterns at preselected locations, corresponding to places in the mold, which are normally difficult to fill with poured sand and difficult to densify such sand;

an open top and bottom box-like flask section arranged to fit over each plate for surrounding each pattern;

means for pouring sand into each flask section for filling, mechanical means for compacting the sand poured into each flask section;

a single pump means connected to both air chambers for simultaneously applying a vacuum to each air chamber during the pouring of the sand and the compacting of the sand within each flask section, to thereby simultaneously produce a vacuum in each of the air passageway holes for assisting in filling and densifying the sand filling within each flask section and around the pattern in the preselected locations during the time the sand is poured and compacted;

a single blower means connected to both air chambers for simultaneously providing pressurized air in each air chamber, at the conclusion of the compacting of the sand, for producing a pressurized flow through the air passageway holes for assisting in separating, and in maintaining the integrity and accuracy of the sand cavity surfaces at said preselected locations while the compacted sand filled flask sections are removed away from the plates and patterns to provide the casting cavities.

* * * * *